US009568176B2

(12) United States Patent
Ye et al.

(10) Patent No.: US 9,568,176 B2
(45) Date of Patent: Feb. 14, 2017

(54) COMPLETELY PLASTIC LED TUBE LIGHT AND MANUFACTURING METHOD THEREOF

(75) Inventors: Zesheng Ye, Shenzhen Guangdong (CN); Xuewei Dai, Shenzhen Guangdong (CN); Nimchung Ku, Shenzhen Guangdong (CN); Middel Tjaco, Shenzhen Guangdong (CN)

(73) Assignee: OSRAM GMBH, Munich (DE)

( * ) Notice: Subject to any disclaimer, the term of this patent is extended or adjusted under 35 U.S.C. 154(b) by 246 days.

(21) Appl. No.: 14/348,059

(22) PCT Filed: Sep. 7, 2012

(86) PCT No.: PCT/EP2012/067541

§ 371 (c)(1),
(2), (4) Date: May 8, 2014

(87) PCT Pub. No.: WO2013/045255

PCT Pub. Date: Apr. 4, 2013

(65) Prior Publication Data

US 2014/0240973 A1 Aug. 28, 2014

(30) Foreign Application Priority Data

Sep. 30, 2011 (CN) ..... 2011 1 0304822

(51) Int. Cl.

| | |
|---|---|
| ***F21V 23/00*** | (2015.01) |
| ***F21K 99/00*** | (2016.01) |
| *F21Y 101/00* | (2016.01) |

(52) U.S. Cl.

CPC ..... *F21V 23/002* (2013.01); *F21K 9/27* (2016.08); *F21K 9/90* (2013.01); *F21Y 2101/00* (2013.01); *Y10T 29/49117* (2015.01)

(58) Field of Classification Search

CPC ..... F21K 9/17; F21K 9/90; F21K 9/27; F21V 23/002; F21Y 2101/02; F21Y 2101/00; Y10T 29/49117

See application file for complete search history.

(56) References Cited

U.S. PATENT DOCUMENTS

| | | | |
|---|---|---|---|
| 6,394,623 | B1 | 5/2002 | Tsui |
| 2003/0218879 | A1 | 11/2003 | Tieszen |

(Continued)

FOREIGN PATENT DOCUMENTS

| | | | |
|---|---|---|---|
| CN | 1109955 | A | 10/1995 |
| CN | 2463640 | Y | 12/2001 |

(Continued)

OTHER PUBLICATIONS

Chinese Office Action based on Application No. 2011103048225(7 Pages and 11 pages of English translation) dated Sep. 7, 2015 (Reference Purpose Only).

(Continued)

*Primary Examiner* — Stephen F Husar

(74) *Attorney, Agent, or Firm* — Viering, Jentschura & Partner mbB

(57) ABSTRACT

A completely plastic LED tube light, may include plastic shell comprising wires embedded therein, wherein two or more projections having greater dimensions than that of the wires are formed on the wires, end caps located at two ends of the plastic shell, respectively, and LEDs positioned in a space enclosed by the plastic shell and the end caps. A method for manufacturing the completely plastic LED tube light is also disclosed.

16 Claims, 4 Drawing Sheets

(56) References Cited

U.S. PATENT DOCUMENTS

| | | | |
|---|---|---|---|
| 2009/0219713 | A1 | 9/2009 | Siemiet et al. |
| 2011/0141723 | A1 | 6/2011 | Lai et al. |

FOREIGN PATENT DOCUMENTS

| | | | |
|---|---|---|---|
| CN | 2635933 | Y | 8/2004 |
| CN | 101629691 | A | 1/2010 |
| CN | 101896754 | A | 11/2010 |
| CN | 102072421 | A | 5/2011 |
| CN | 102095172 | A | 6/2011 |
| DE | 202010008114 | U1 | 11/2010 |
| EP | 2208922 | A1 | 7/2010 |

OTHER PUBLICATIONS

International Search Report issued in the corresponding PCT application No. PCT/EP2012/067541 dated Dec. 4, 2012.
Chinese Office Action based on application No. 201110304822.5 (7 pages, 12 pages of English translation) dated Feb. 4, 2016 (for reference purpose only).
Cinese Office Action basen on application No. 201110304822.5 (7 pages and 5 pages of English translation) dated Aug. 3, 2016.

COMPLETELY PLASTIC LED TUBE LIGHT AND MANUFACTURING METHOD THEREOF

RELATED APPLICATIONS

The present application is a national stage entry according to 35 U.S.C. §371 of PCT application No.: PCT/EP2012/067541 filed on Sep. 7, 2012, which claims priority from Chinese application No.: 201110304822.5 filed on Sep. 30, 2011, and is incorporated herein by reference in its entirety.

TECHNICAL FIELD

Various embodiments relate to a completely plastic LED tube light, particularly, to a completely plastic LED tube light which can prevent its plastic shell from deforming. Various embodiments also relate to a method for manufacturing the completely plastic LED tube light.

BACKGROUND

There are two typical types of LED tube light in the market. The first type of LED tube light has a shell. Part of the shell is made of plastics forming a transparent portion for transmitting light to outside, and other parts of the shell is made of aluminum heat sink which is opposite to a mounting surface for mounting the LED tube light. The disadvantages of such LED tube light lies in its expensive manufacturing cost, limiting its wide application.

To reduce manufacturing cost, as the LED tube light develops, the second type of LED tube light emerges in the market, which uses a shell totally made of plastics instead of comprising a metal heat sink therein to reducing manufacturing cost. That is, it is a completely plastic LED tube light and it has become more and more popular. However, though it is not as expensive as the first type of the LED tube light, it has another undesirable defect. That is, as time goes, especially in cases when the light is on and a lot of heat is generated, the plastic shell will begin to deform. Such deformation may cause bad contact between some circuits in the tube light, and thus cause failure in the light. Moreover, because such deformation is irreversible, the amount of deformation becomes bigger and bigger as time goes by, which means users have to exchange it after a not long period of time, thus increasing the usage cost.

FIG. 1A is a side view showing the second type of completely plastic LED light 1 in the related art, in which the plastic shell 2 has not deformed, FIG. 1B is a side view showing the second type of completely plastic LED light 1 in the related art, in which the plastic shell 2 has deformed after being used for a period of time. As shown in FIGS. 1A and 1B, the tube light comprises a plastic tubular shell 2 and two end caps 3 at both ends of the plastic tubular shell 2.

The above defects of the completely plastic LED light in the related art result in that it cannot be a LED tube light of high quality and good performance. Currently, no completely plastic LED light which can prevent its plastic shell from deforming has been disclosed.

SUMMARY

Various embodiments provide a new completely plastic LED light which can prevent its plastic shell from deforming, which can overcome the above defects in the related art.

Meanwhile, various embodiments provide a method for manufacturing the new completely plastic LED light.

A completely plastic LED tube light according to various embodiments, including: plastic shell including wires embedded therein, two or more projections having greater dimensions than that of the wires are formed on the wires; end caps located at two ends of the plastic shell, respectively; and LEDs 12 positioned in a space enclosed by the plastic shell and the end caps. Various embodiments also provides a method for manufacturing the completely plastic LED tube light.

A method for manufacturing a completely plastic LED tube light according to various embodiments, including the steps of delivering raw materials for making plastic shell into an inlet of an extrusion device for manufacturing the completely plastic LED tube light; continuously embedding the wires having projections into the raw materials of liquid phase in a direction by a wire feeding device; extruding solid plastic shell having wires with projections from outlets of the extrusion device by the extrusion device; and assembling the plastic shell and other parts of the completely plastic LED tube light together.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figures 1A, 1B:
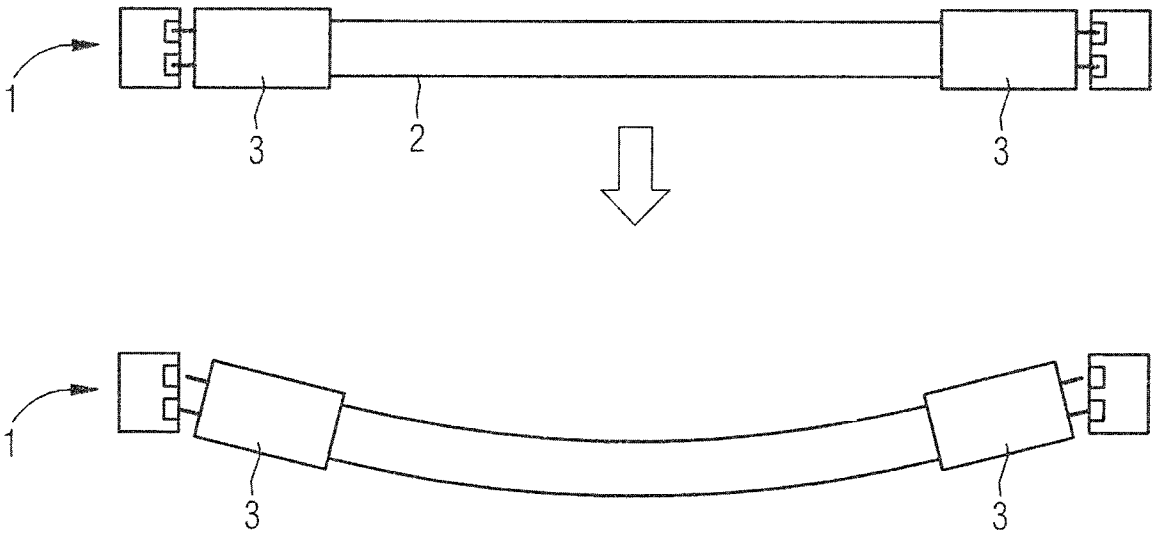
FIG. 1A is a side view showing a completely plastic LED tube light in the related art, in which the plastic shell of the tube light has not deformed.
FIG. 1B is a side view showing a completely plastic LED tube light in the prior art, in which the plastic shell of the tube light has deformed.
Figures 2A, 2B, 2C:
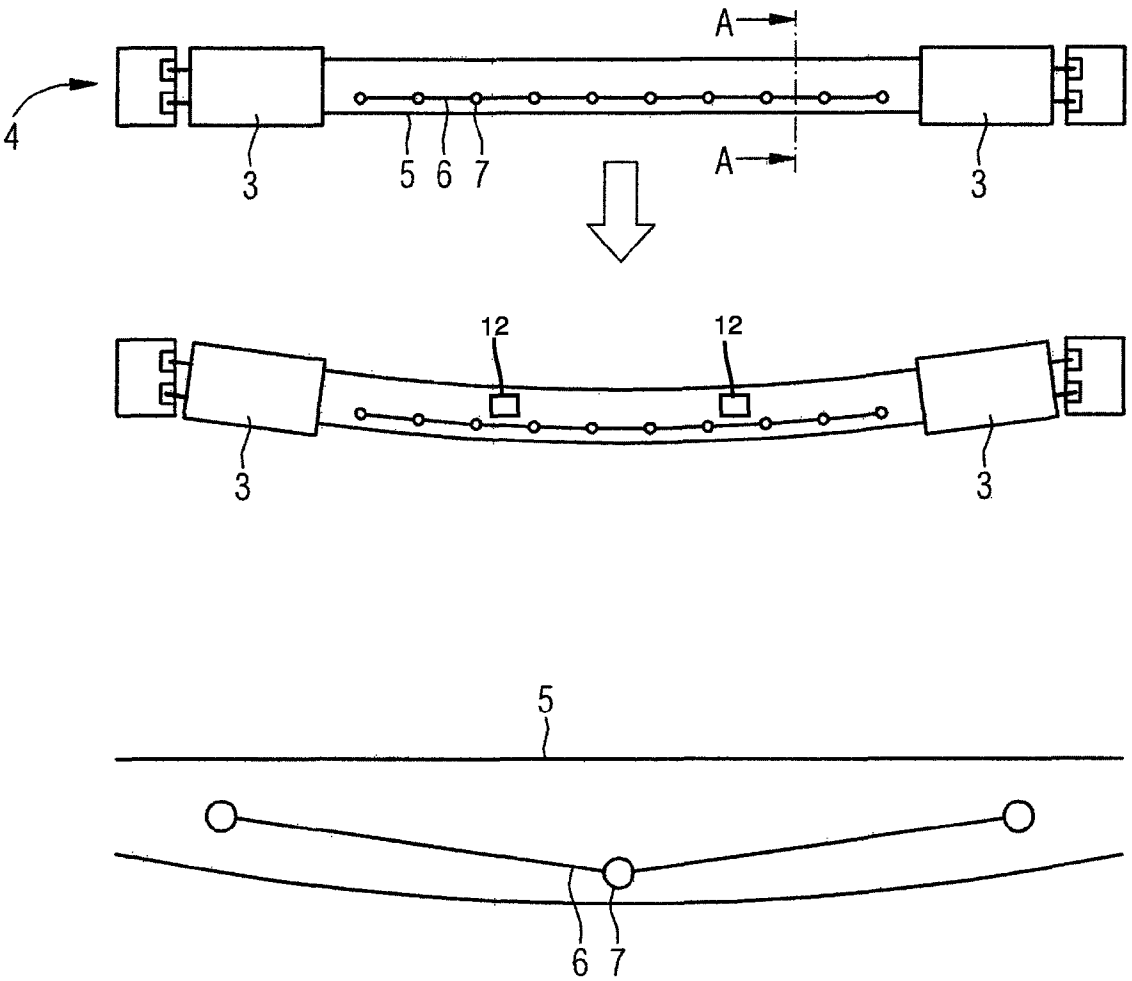
FIG. 2A is a side view showing a completely plastic LED tube light according to various embodiments, in which the plastic shell of the tube light has not deformed.
FIG. 2B is a side view showing a completely plastic LED tube light according to various embodiments, in which the plastic shell of the tube light has deformed, and FIG. 2C shematically shows the principal of the completely plastic LED tube light according to various embodiments to prevent its plastic shell from deforming.

FIG. 2A is a side view showing a completely plastic LED tube light 4 according to the disclosure, in which the plastic shell of the tube light 4 has not deformed, and FIG. 2B is a side view showing a completely plastic LED tube light 4 according to the disclosure, in which the plastic shell of the tube light 4 has deformed. To simplify the figures, LEDs for constructing the completely plastic LED tube light are omitted in some figures. As shown in FIGS. 2A and 2B, to prevent plastic shell 5 of the tube light 4 from deforming due to the heat generated by the light during usage, according to the disclosure, wires are embedded in plastic shell 5 made of PC or PMMA. Two or more projections 7, having gibber dimensions than that of the wires 6, are formed on the wires 6, so that friction occurs between projections 7 and the plastics contacting therewith when the plastic shell 5 deforms. The projections 7 can be of any shape which has a bigger size than the wires 6, for example of spherical, or ellipsoid or cube shape. The wires 6 can extend part of the lengths of the plastic shell 5, preferably extent entire lengths of the plastic shell 5. The wires 6 are made of materials having less stretch than plastic so as not to deform easily, for example, are made of metals, and preferably made of copper or steels. Projections 7 and wires 6 can be made of the same or different materials. Projections 7 and wires 6 can be made integrally, or separately and then bonded together by welding or other means. Preferably, wires 6 with projections 7 are embedded in the plastic shell 5 in an extrusion molding method, which will be described further in combination with FIG. 4 below.

FIG. 2C schematically shows the principal of the completely plastic LED tube light 4 according to the disclosure to prevent its plastic shell 5 from deforming. During usage of the tube light 4, the plastic shell 5 tends to soften due to heat generated by the light and thus to deform, as shown in FIG. 2B. When such changes happens to the plastic shell 5, wires 6 embedded in the plastic shell 5 is subject to a pulling force due to such changes of the plastic shell 5, as shown in FIG. 2C. At this time, projections 7 of the wires 6 tends to slide in softening plastics, thereby creating frictions between projections 7 and plastics contacting therewith. Such frictions will create resistance, preventing projections 7 from sliding in the plastic shell 5. That is to say, friction force between projections 7 and plastics prevents projections 7 from sliding, thus prevents wires 6 between adjacent projections 7 from deforming by stretching and further prevents the deformation of the plastics shell.

Figure 3:
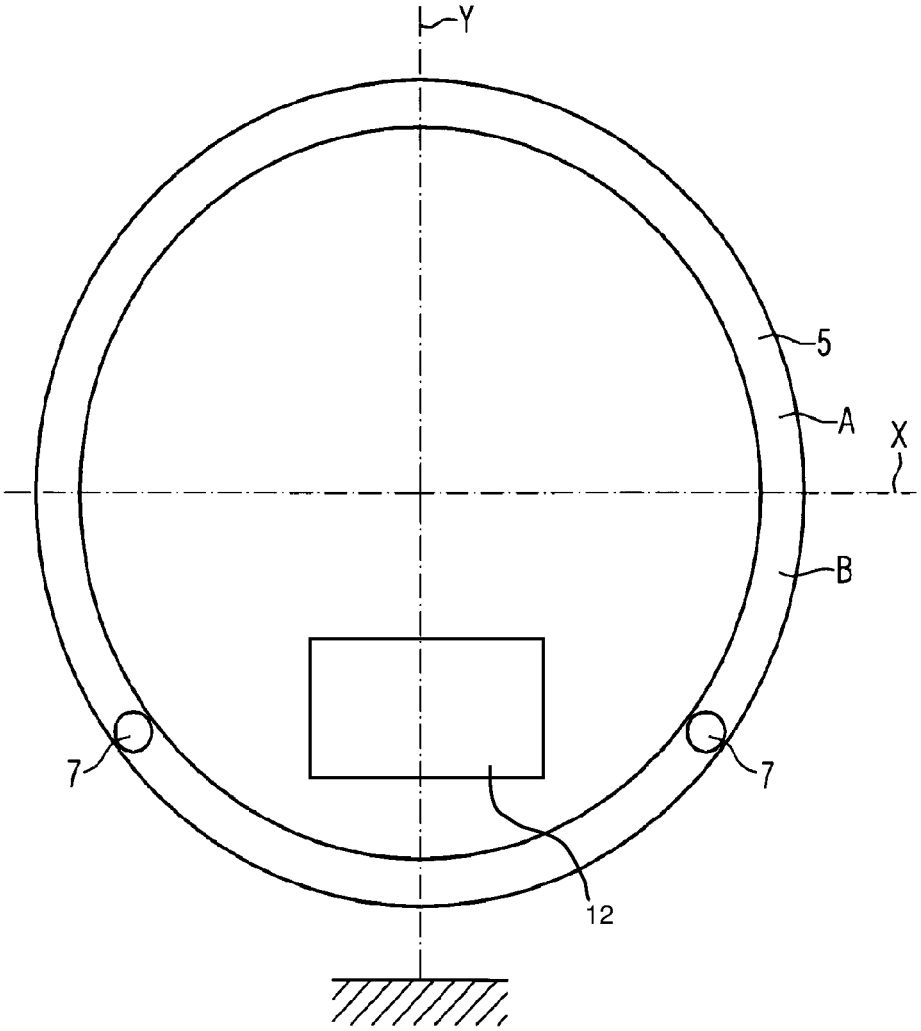
FIG. 3 shows a sectional view of the plastic shell of the completely plastic LED tube light taken along line A-A of FIG. 2A.

FIG. 3 shows a sectional view of the plastic shell 5 of the completely plastic LED tube light 4 taken along line A-A of FIG. 2A. As can be seen from FIG. 3, the plastic shell 5 has a circular section. For convenient of explanation, the plastic shell is herein divided into a transparent portion A (the portion above the axis X) for transmitting light to outside and a mounting portion B (the portion below the axis X) opposite to a wall or other mounting surface on which the tube light is mounted. Generally, wires 6 with projections 7 is formed in the mounting portion B of the plastics shell 5, to avoid the influence of the projections 7 on the light pattern and effects of the tube light. However, wires 6 with projections 7 can be also formed in the transparent portion A of the shell. In order to prevent the plastics shell 5 from deforming better, preferably, wires 6 with projections 7 is arranged in the shell 5 perpendicular to the axis Y of the wall or the other mounting surface. Of course, wires 6 can also be arranged in asymmetrical or other manners.

Figure 4:
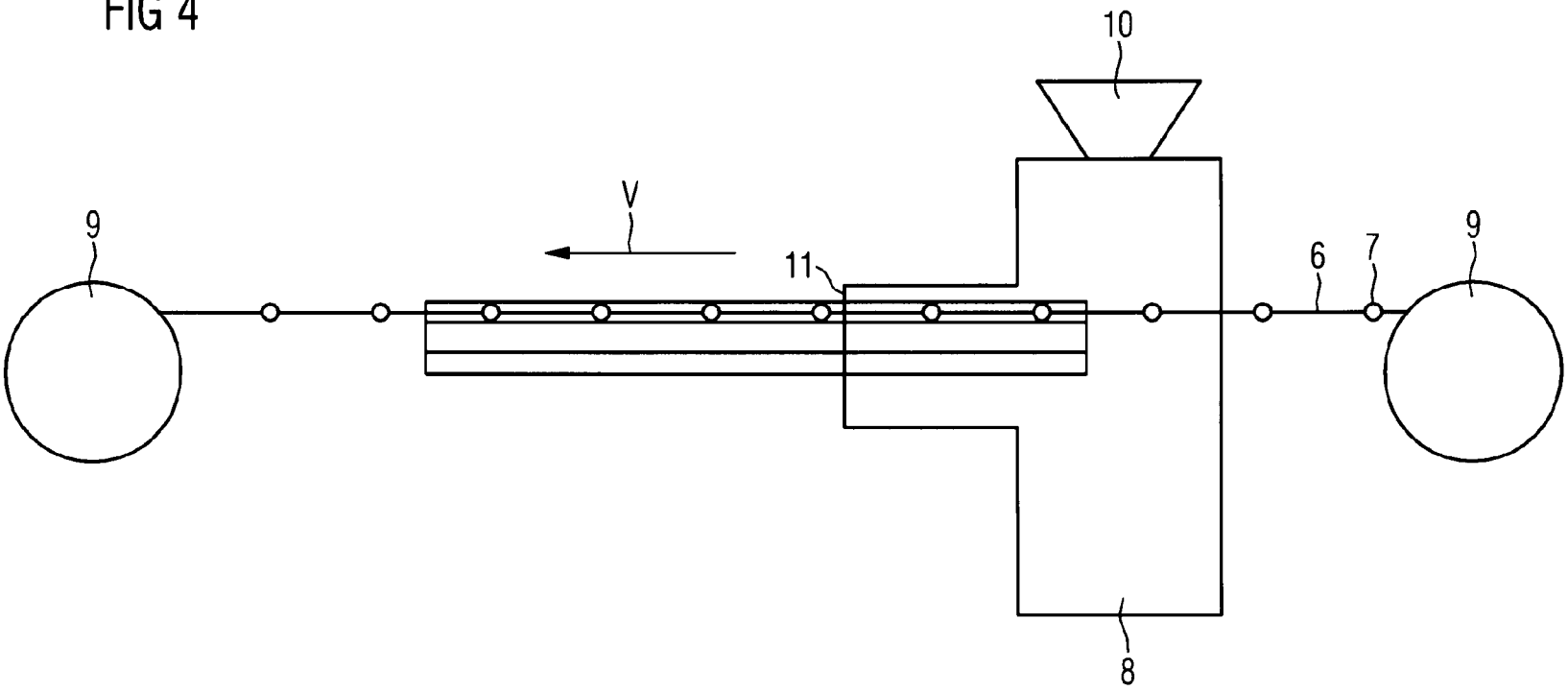
FIG. 4 schematically shows a method for manufacturing the completely plastic LED tube light according to various embodiments.

FIG. 4 schematically shows a method for manufacturing the completely plastic LED tube light 4 according to the disclosure. As is shown in FIG. 4, this method for manufacturing the completely plastic LED tube light is substantially the same as that in the prior art, except that there is a step of embedding wires 6 with projections 7 into liquid PC or PMMA raw materials, curing and then obtaining the final product. Below are descriptions of steps of the method. Firstly, delivering PC or PMMA raw materials for making plastic shell 5 of the LED tube light 4 into an inlet 10 of an extrusion device 8 for manufacturing the plastic shell 5 of the completely plastic LED tube light 4; secondly, continuously embedding the wires 6 having projections 7 into the PC or PMMA raw materials of liquid phase in a direction indicated by an arrow B by a wire feeding device 9; thirdly, extruding solid plastic shell having wires 6 with projections 7 at a certain of extruding velocity V from outlets 11 of the extrusion device by the extrusion device 8; and lastly, assembling the obtained plastic shell 5 and other parts of the completely plastic LED tube light 4 together, thus obtaining a completely plastic LED tube light 4 according to the disclosure.

The completely plastic LED tube light according to the disclosure can be sued in T10, T8 and T5 LED products. By the method for manufacturing the completely plastic LED tube light according to the disclosure, T10, T8 and T5 LED light can be produced which can prevent its plastic shells from deforming.

The completely plastic LED tube light according to the disclosure reduces manufacturing cost by embedding wires with projections into plastic shell in an extrusion method.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A completely plastic LED tube light, comprising:

plastic shell comprising wires embedded therein, wherein the embedded wires have formed thereon two or more projections whose dimensions are greater than that of the embedded wires;

end caps located at two ends of the plastic shell, respectively; and

LEDs positioned in a space enclosed by the plastic shell and the end caps.

2. The completely plastic LED tube light according to claim 1, wherein the wires are embedded into the plastic shell in an extrusion process.

3. The completely plastic LED tube light according to claim 1, wherein the plastic shell is made of polycarbonate or PMMA.

4. The completely plastic LED tube light according to claim 1, wherein the wires extend entire or part of the lengths of the plastic shell.

5. The completely plastic LED tube light according to claim 1, wherein the wires are made of materials having less stretch than plastic.

6. The completely plastic LED tube light according to claim 1, wherein the wires are made of metals.

7. The completely plastic LED tube light according to claim 6, wherein the wires are made of copper or steel.

8. The completely plastic LED tube light according to claim 1, wherein the wires and the projections are formed integrally or formed separately and then secured together.

9. The completely plastic LED tube light according to claim 1, wherein the wires and the projections are made of same or different materials.

10. The completely plastic LED tube light according to claim 1, wherein the projections are of spherical, or ellipsoid or cube shape.

11. The completely plastic LED tube light according to claim 1, wherein the projections are made of metals.

12. The completely plastic LED tube light according to claim 11, wherein the projections are made of copper or steel.

13. The completely plastic LED tube light according to claim 1, wherein the wires having the projections are formed in a mounting part of the plastic shell.

14. The completely plastic LED tube light according to claim 1, wherein the wires having the projections are formed in both of a mounting part and a transparent part of the plastic shell.

15. The completely plastic LED tube light according to claim 1, wherein the wires having the projections are arranged symmetrically in the plastic shell with respect to an axis perpendicular to a wall or other mounting faces.

16. A method for manufacturing a completely plastic LED tube light, the method comprising:

delivering raw materials for making plastic shell into an inlet of an extrusion device for manufacturing the completely plastic LED tube light;

continuously embedding wires having projections into the raw materials of liquid phase in a direction by a wire feeding device;

extruding solid plastic shell having the wires with projections from outlets of the extrusion device by the extrusion device; and assembling the plastic shell and other parts of the completely plastic LED tube light together.

* * * * *